United States Patent [19]

Saunders et al.

[11] Patent Number: 4,457,150

[45] Date of Patent: Jul. 3, 1984

[54] METHOD OF FORMING D&I CANS FROM COATED STEEL

[75] Inventors: William T. Saunders; Lowell W. Austin, both of Weirton, W. Va.; John R. Smith, Richmond, Ohio; William D. Bingle, Endicott, N.Y.

[73] Assignee: National Steel Corporation, Pittsburgh, Pa.

[21] Appl. No.: 347,705

[22] Filed: Feb. 11, 1982

[51] Int. Cl.[3] ..... B21D 22/28

[52] U.S. Cl. ..... 72/47; 72/349

[58] Field of Search ..... 72/349, 42, 47; 428/925, 926, 935; 148/31.5; 204/38 R, 43 T; 220/454, 455, DIG. 22

[56] References Cited

U.S. PATENT DOCUMENTS

| | | | |
|---|---|---|---|
| Re. 28,511 | 8/1975 | Avitzur | 72/347 |
| 2,748,068 | 5/1956 | Faust et al. | 204/43 T |
| 3,245,885 | 4/1966 | Asano et al. | 428/628 |
| 3,293,895 | 12/1966 | Kohan et al. | 72/349 |
| 3,295,936 | 3/1967 | Asano et al. | 428/628 |
| 3,360,157 | 12/1967 | Bolt et al. | 72/349 |
| 3,765,206 | 10/1973 | Shah et al. | 72/47 |
| 3,930,396 | 1/1976 | Martinez | 72/347 |
| 3,978,803 | 9/1976 | Asano et al. | 72/47 |
| 4,040,282 | 8/1977 | Saunders | 72/41 |
| 4,193,279 | 3/1980 | Maeder | 72/349 |
| 4,254,652 | 3/1981 | Proctor | 72/467 |

*Primary Examiner*—Daniel C. Crane
*Assistant Examiner*—David B. Jones
*Attorney, Agent, or Firm*—O'Neil & Bean

[57] ABSTRACT

Drawn and ironed can bodies are formed from cold rolled steel sheet having a thin coating of a nickel-zinc alloy electroplated thereon by drawing the coated steel into a cup and ironing the sidewall of the cup on a mandrel by passing it through a toolpack comprising a plurality of ironing rings each including a generally conical lead-in surface having an angle relative to the axis of the mandrel within the range of 6° to 8½° and a substantially cylindrical land extending no more than about 0.025 inches in the axial direction of the toolpack through the rings. The diameter of the land on successive ironing rings is progressively smaller in the direction of movement of the can through the toolpack, with the diameter of the final ironing ring being such as to reduce the sidewall of the cup to about one half its original thickness. The length of the land of the final ironing ring may be less than that of the previous ironing rings and preferably is within the range of 0.003 to 0.007 inches.

9 Claims, 5 Drawing Figures

METHOD OF FORMING D&I CANS FROM COATED STEEL

This invention relates to forming one-piece steel can bodies and more particularly to forming one-piece steel can bodies by a drawing and ironing process from cold rolled sheet steel having a thin coating of a nickel-zinc alloy electroplated on its surfaces.

It is well known to form containers, or cans, and particularly beverage cans, by a drawing and ironing process wherein flat sheet metal fed from a coil is die cut into circular blanks which are initially drawn into shallow cups having side and bottom walls of substantially equal thickness. The cups may then be redrawn to further reduce their diameter and increase their height before being ironed on a punch, or mandrel, having an external diameter substantially equal to the internal diameter of the cups. The mandrel forces the cups through a plurality of ironing dies, or rings, whose inside diameter are each smaller than the outside diameter of the cup passing therethrough so that pressure between the ironing dies and the mandrel progressively reduces the thickness of the sidewall and forces the metal along the mandrel to increase the height of the can body.

In the past, difficulty has been encountered in forming drawn and ironed can bodies from uncoated flat, cold rolled steel. The substantial forces required by the ironing step frequently resulted in tearing of the thinned sidewall, or pushing the mandrel through the bottom. Thus, it has generally been found necessary to provide a coating of a softer metal such as tin on both sides of the steel base metal as a lubricating coating in order to successfully iron the sidewalls to the desired thickness.

While tinplate can be drawn and ironed to produce commercially acceptable containers, a coating thickness of from about 15 microinches up to about 30 microinches on each side of the base steel has generally been considered necessary. This heavy tin coating not only greatly increases the cost of the completed cans, but there is also a tendency for the tin to flow or be drawn from plateaus and deposited in valleys of the base steel surface during the ironing step, with the result that the thickness of the tin coating on the finished product varies widely.

It has been found that cups drawn or drawn and redrawn (hereinafter drawn) from nickel plated steel can be ironed if a nickel-zinc alloy coating containing a high percentage of nickel is employed for the coating instead of pure nickel. Such a nickel-zinc coating is disclosed in copending application Ser. No. 233,569, now U.S. Pat. No. 4,374,902. The present invention employs nickel-zinc coated sheet steel of the type disclosed in that prior application and enables drawn and ironed cans to be successfully produced on high-speed commercial presses, with the resulting drawn and ironed cans being of good commercial quality suitable for packaging foods and beverages. Ironing ring wear is low, resulting in extended tool life.

In accordance with the present invention, a cold rolled steel sheet such as blackplate has a thin, substantially uniform coating of a nickel-zinc alloy plated on both sides. The coating may be within the range of about ½to 5 microinches in thickness, and preferably is about 1 to 3 microinches. The coating is nickel rich and may contain zinc within the range of about 2 to about 12 percent by weight, and preferably within the range of about 5 to about 10 percent. The coating is applied by drawing a running length of the steel through a conventional nickel electroplating bath to which the desired amount of zinc has been added, preferably in the form of zinc sulfate. The nickel-zinc alloy coated steel may be chemically treated to increase storage life of the material and/or to enhance adhesion of organic coatings. The coated steel sheet is cut into circular blanks which are drawn into cups having bottom and sidewalls of substantially equal thickness, and then ironed to provide low cost containers suitable for use in packaging foods and beverages.

The cups are supported on a cylindrical mandrel, or punch, having an external diameter corresponding to the internal diameter of the finished can body and passed through a toolpack consisting of a plurality of axially aligned, spaced ironing dies, or rings, with the diameter of the opening in the successive ironing rings being progressively smaller from the first to the last ironing ring and each being slightly smaller than the external diameter of the sidewall of the container passing therethrough. Each ironing ring has a generally conical lead-in portion intersecting a substantially cylindrical land and an outwardly diverging, generally conical exit portion. The conical lead-in portion of each die has a half-cone angle, i.e., the angle of the conical surface in relation to the axis of the toolpack, within the range of about 6 to about 8.5°, preferably about 7.5°, with the land having a length in the axial direction of movement of the punch, which does not exceed about 0.025 inches. The final ironing ring has a land which is shorter than 0.025 inches, preferably within the range of about 0.003 to about 0.007 inches.

The diameter of the land portion of the respective ironing rings is such that the thickness of the sidewall of the finished drawn and ironed can body is about one-half that of the drawn cup before ironing. Further, the sidewall thickness reduction may not be accomplished equally in all rings, but at least about one-half of the total reduction is accomplished in the final ironing ring, with the remaining reduction being accomplished in the first and second ironing rings.

The invention will be described hereinbelow with reference to the drawings, in which.

Figure 1:
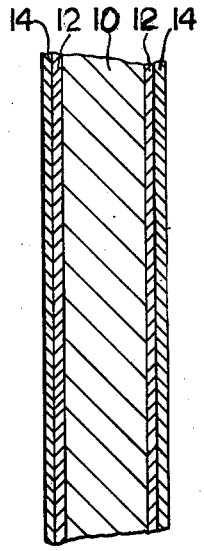
FIG. 1 is a fragmentary sectional view, on an enlarged scale, of a cold rolled steel sheet having a nickel-zinc alloy coating on its surface.

Referring now to the drawings in detail, the present invention involves forming a drawn and ironed container, or can, from cold rolled mild steel such as blackplate having a thickness and temper corresponding to that conventionally employed for tinplate used to form drawn and ironed cans. As shown in FIG. 1, the steel sheet 10 has a coating of a nickel-zinc alloy 12 on its opposed surfaces, and preferably the nickel-zinc alloy coating is treated in a dichromate or chromic acid solution, or other chemical solution, to apply a protective coating 14 which increases the storage life of and enhances lacquer adhesion to the plated steel. Also, a suitable lubricant such as ATBC is preferably applied to the chemically treated surfaces by suitable means such as an electrostatic lubricator known in the art. The nickel-zinc alloy coating is very thin and may be in the range of about 0.5 to about 5.0 microinches, but preferably is within the range of about 1.0 to about 3.0 microinches.

The alloy coating 12 is nickel rich in that the ratio of the percentage of nickel to zinc in the alloy is relatively high. However, less than about 2% zinc, by weight, in the coating produces inferrior results, and at least about 5% zinc is preferred to assure uniformly good results. While satisfactory results have been obtained in accordance with the present invention employing zinc percentages within the range of from at least 2 to about 12 percent of the total weight of the alloy coating, best results were obtained when the coating contained from about 5 percent to about 10 percent and preferably about 8 percent zinc. Zinc in excess of about 12 percent of the total coating weight produced less favorable surfaces on the finished can body and resulted in greater difficulty in stripping the ironed can from the mandrel.

Figure 2:
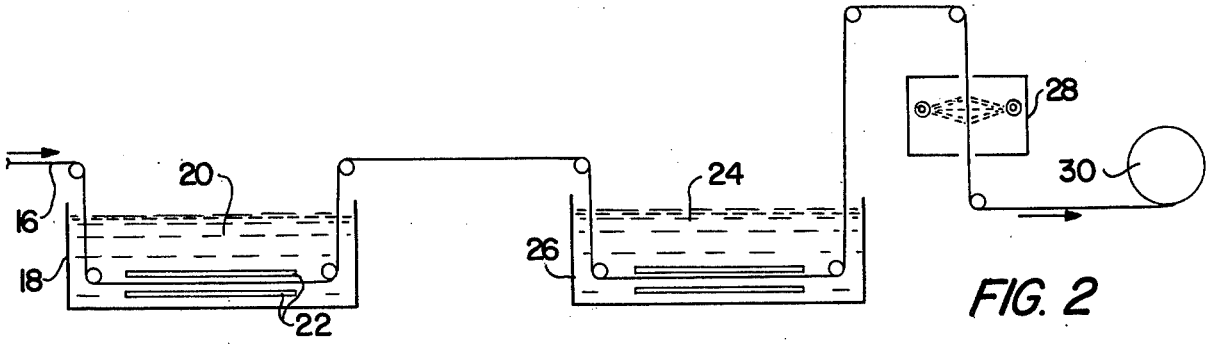
FIG. 2 is a schematic illustration of a high-speed plating and treating line suitable for producing the nickel-zinc coated steel sheet employed in the invention.

The extremely thin nickel coating, described above, may be applied on a high-speed nickel plating line schematically illustrated in FIG. 2 wherein a running length of sheet steel 16, typically 85 pound blackplate having a T4 temper, is initially passed through an electrolytic tank 18 containing a quantity of nickel electrolyte solution 20 into which the desired amount of zinc sulfate ($ZnSo_4.7\ H_2O$) has been added to give the desired zinc concentration. Electric current is applied through electrodes 22 to produce the desired coating thickness and characteristics depending on the line speed throught the solution. From the nickel plating bath, the coated steel strip may then be passed through a chemical treatment bath 24 in tank 26 before being lubricated as by an electrostatic oiler 28 then wound into a coil 30. The chemical treatment may be cathodic dichromate or chromic acid treatment of the type known in the art.

Figure 3:
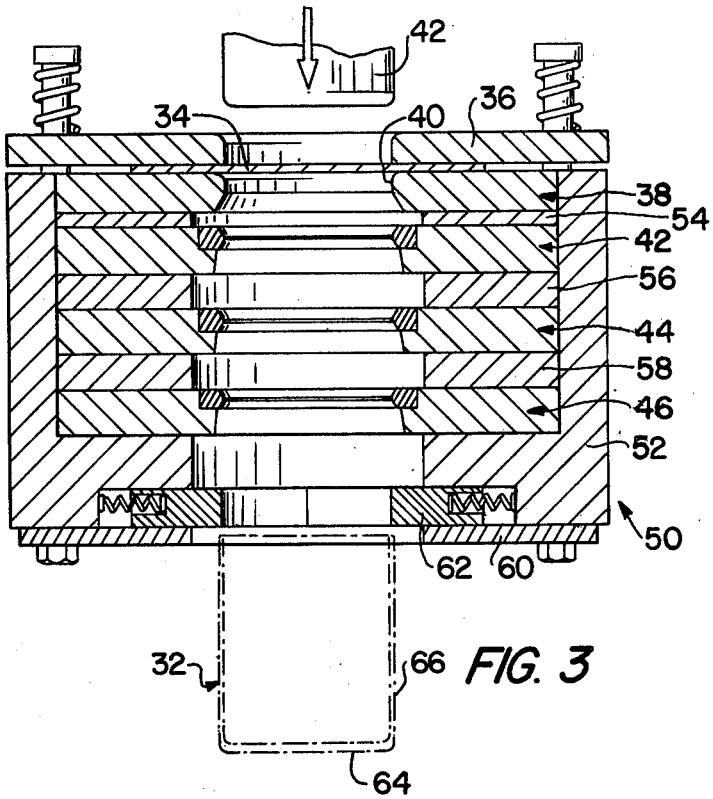
FIG. 3 is a sectional view schematically illustrating an ironing ring toolpack and punch of the type employed in the present invention and shown in the process of ironing a can body from a cup drawn from the nickel-zinc coated steel sheet shown in FIG. 1.

The drawn and ironed cans may be formed by initially cutting the nickel-zinc coated steel material into circular blanks and forcing the blanks through a circular die by use of a cylindrical drawing punch to form shallow cups. As is known in the can forming art, the cups may then be removed and redrawn and ironed in a separate operation or the drawing and ironing operations may be carried out in a continuous stroke of the mandrel as schematically illustrated in FIG. 3. Thus, a can body 32 may be formed by initially drawing a blank 34 which has been clamped as by the clamping member 36 which cooperates with the face surface of a drawing die ring 38 to slip-hold the peripheral edge portion of the blank during drawing through the opening 40 of drawing ring 38 by a cylindrical mandrel, or punch 42.

Continued downward movement of the mandrel 42 passes the cup through a series of two or three ironing ring assemblies 44, 46, 48 arranged in aligned, spaced relation to one another, in a toolpack designated generally by the reference numeral 50. Annular spacer members 54, 56 and 58, respectively, are positioned between and accurately locate the drawing ring 38, and the first, second and third ironing rings 42, 44 and 46, respectively within a housing 52. At the exit end of the toolpack, a stripper assembly 62 is in position to engage the top edge portion of a drawn and ironed can body 32 on the mandrel 42 at the end of the ironing stroke to strip the can body from the mandrel upon its return stroke. Upon completion of the ironing operation, the can 32 has a bottom wall 64 having a thickness substantially equal to the thickness of the blank 34 and a sidewall 66 which preferably is about one-half the thickness of bottom wall 64.

Figure 4:
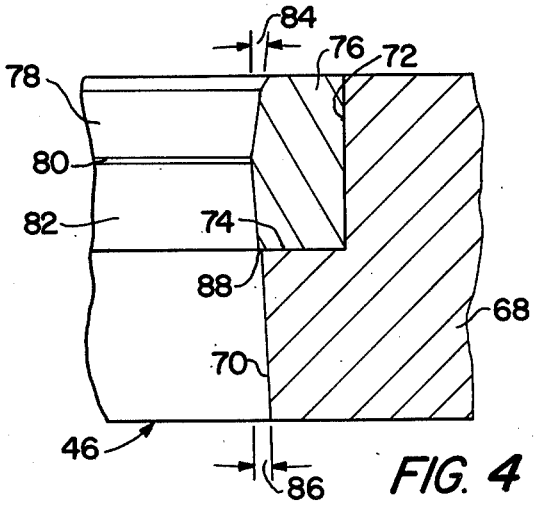
FIG. 4 is a further enlarged, fragmentary sectional view of one of the drawing rings illustrated in FIG. 3.
Figure 5:
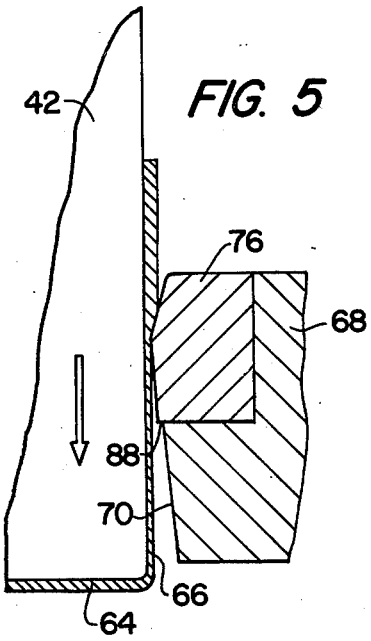
FIG. 5 is a fragmentary sectional view schematically showing a steel cup in the process of having its sidewall thickness reduced by the final ironing ring of the toolpack shown in FIG. 3.

Referring now to FIGS. 4 and 5, the structure and function of the ironing ring assemplies 42, 44 and 46 will be described more fully; however, since the three ironing ring assemblies are substantially identical in construction except for the diameter and the length, in the axial direction, of the cylindrical land portion of the respective drawing ring assemblies, only the drawing ring assembly 46 will be described in detail, it being understood that the description applies equally to drawing ring assemblies 42 and 44. Also, it should be understood that only two ironing rings may be employed in the toolpack.

Drawing ring assembly 46 comprises a rigid annular support plate 68 having a generally conical, axial opening defined by the surface 70 extending upward from its bottom surface, i.e., the surface defining the exit side of the assembly. A counterbore is formed in the top, or entrance side of the support plate 68 and defines a cylindrical guide surface 72 terminating at a radial shoulder, or seat, 74. Guide surface 72 and radial shoulder 74 are accurately machined and cooperate to receive and accurately position an annular ironing die 76.

Ironing die 76 has an axial opening formed therein defined by a conical entrance, or lead-in portion 78, a central cylindrical land 80, and a conical exit portion 82. The conical lead-in portion 78 has a semi-cone angle 84, i.e., the angle of the surface relative to the draw axis of the toolpack, within the range of about 6° to about 8½°, preferably about 7½°. The inner or small diameter end of the lead-in portion intersects the cylindrical surface of the land portion 80, and the cylindrical land 80, in turn, intersects the inner, small diameter surface of conical exit portion 82. Since the axial length of the land 80 is very small, the semi-cone angle 86 of the conical exit surface 82 is also preferably relatively small, typically about 2½°. The maximum diameter of conical exit surface 82 is preferably slightly less than the minimum diameter of the conical surface 70, thereby providing a narrow overhang, or shoulder 88 at the radially inner edge of the radial seat 74.

During the ironing process, reduction in thickness of the sidewall 66 is accomplished by the tapering or conical lead-in surface 78; however, due to the compressive loads in the metal being ironed, and to the resiliency of this metal, substantial pressure is exerted on the cylindrical wall of the land. The land 80 of the respective ironing rings is very short and should not exceed about 0.025 inches for the first and second rings and less than 0.025 for the third ring die in which the land may be as short as 0.003 inches and preferably is within the range of about 0.003 to about 0.007 inches.

In accordance with the present invention, the nickel-zinc coated steel can be drawn and ironed to reduce the thickness of the sidewall portion of a drawn cup about one-half the original thickness of the coated steel blank to produce the thin sidewall 66 of the finished can. While reductions of this magnitude have previously been achieved for steel, it has generally not been possible in a high-speed commercial operation utilizing tin-free steel, i.e., steel sheet not having a heavy lubricating coating of tin on its surfaces. In accordance with this invention, the substantial sidewall reduction is achieved by utilizing the nickel-zinc coated steel in combination with ironing ring die diameters such that about 50 percent of the total reduction, i.e., about 25 percent of the original thickness of the blank 34, is accomplished in the final ring die, with the remainder of the reduction being accomplished in the preceeding ring die or dies. When three ironing rings are employed in the toolpack it is preferred that about 20 to 25 percent of the reduction be accomplished in the first ring die and about 25 to 30 percent in the second ring die.

In tests conducted employing this invention, 56,000 cans were ironed utilizing a toolpack in which the first and second ring dies each had a lead-in angle of $7\frac{1}{2}°$ and a land length of 0.025 inches. The third ring die had the same lead-in angle, but had a land length of only 0.003 inches. The diameter of the land of the respective ring dies were such as to produce the desired sidewall reduction in steps within the ranges just described. The ring dies showed no measurable wear and still had a smooth surface after ironing this number of cans in a high-speed commercial redrawing and ironing press.

These tests were repeated using first and second ring dies as described above, with the third ring die having the same diameter but with the land being increased to 0.010 inches. Again, 56,000 cans were successfully ironed without measurable wear on the ring dies; however, it was necessary to stop and repolish the surface of the mandrel once before this number of cans could be ironed. The outer surface of the sidewalls of the cans were good, displaying no scratching.

In both of the tests, just described, the steel sheet material used was cold rolled 85 pound blackplate having a T4 temper and having a nickel-zinc alloy coating containing about 7% zinc with the coating thickness being approximately 3 microinches. In these tests, the blanks were initially drawn to a cup diameter of 3.578 inches and subsequently redrawn to a diameter of 2.612 inches before being ironed. The thickness of the finished ironed sidewall was within the range of 0.0035 to 0.0036 inches with the bottom wall being within the range of 0.0063 to 0.0065 inches.

Attempts to repeat the test using ironing dies having a land greater than about 0.025 inches were unsuccessful due to excessive can breakage. Some difficulty was encountered when using a 0.025 inch land length in the third ring due to the mandrel galling, and it was necessary to polish the mandrel after ironing 12,000 cans, after the 16,000 cans, and again after 53,000 cans. No difficulty was encountered with short cans, breakage, or mandrel galling when utilizing a 0.003 inch land in the third ring. Since the finish of the 0.003 inch land ring was smooth, and no measurable change in diameter resulted after 56,000 cans, the number of cans which could have been ironed using this toolpack is not known; however, it is apparent that a much larger number of cans could have been ironed before tool changing would be required. Although extensive production-line testing has not been conducted on all possible land lengths, preliminary testing of die rings having lands less than 0.010 inches indicated that best results are achieved when the land is very short and preferably within the range of about 0.003 to 0.007 inches.

While preferred embodiments of the invention have been described, it should be understood that it is not intended to be restricted solely thereto, but rather that it is intended to include all embodiments thereof which would be apparent to one skilled in the art and which come within the spirit and scope of the invention.

What is claimed is:

1. A process for forming a drawn and ironed container from flat sheet steel comprising, applying a nickel-zinc alloy coating of substantially uniform thickness to both sides of a sheet of flat rolled steel of a gage and temper suitable for drawing and ironing, said alloy coating containing zinc in the amount of about 2 to 12 weight percent with the remainder consisting essentially of nickel.

drawing the nickel-zinc alloy coated steel into a cup having sidewall and bottom wall thicknesses substantially equal to the thickness of the coated steel, and ironing the sidewall of the drawn cup to reduce the sidewall thickness and increase the height to produce a drawn and ironed can body by supporting the drawn cup on a mandrel and passing the cup through an ironing ring toolpack including at least two ironing ring dies aligned with one another and each having a conical lead-in portion, a cylindrical land portion and a conical exit portion, the toolpack including a final ring die having a land which is less than 0.025 inches in length and which is sustantially less than the length of the land of any preceding die ring in the toolpack.

2. The process as defined in claim 1 wherein the half-cone angle of the conical lead-in portion of each said ring die is within the range of about 6 to about 8.5 degrees.

3. The process as defined in claim 2 wherein the half-cone angle of the conical lead-in portion of each said ring die is about 7.5 degrees.

4. Theprocess according to claim 1, wherein the toolpack includes three die rings and wherein the length of the land of the first ring die is about 0.0025 inches and wherein the length of the land of the second ring die is no greater than about 0.010 inches.

5. The process according to claim 4 wherein the length of the land of the final ring die is within the range of about 0.003 to about 0.007 inches.

6. The process defined in claim 5 wherein the thickness of the nickel-zinc alloy coating on each side of the sheet steel is within the range of about 0.5 to about 5.0 microinches.

7. The process according to claim 6 wherein the thickness of the nickel-zinc coating on each side of the sheet steel is within the range of about 1.0 to about 3.0 microinches.

8. The process defined in claim 1 wherein the thickness of the nickel-zinc alloy coating on each side of the sheet steel is within the range of about 0.5 to about 5.0 microinches.

9. The process according to claim 8 wherein the thickness of the nickel-zinc coating on each side of the sheet steel is within the range of about 1.0 to about 3.0 microinches.

* * * * *

UNITED STATES PATENT AND TRADEMARK OFFICE

CERTIFICATE OF CORRECTION

PATENT NO. : 4,457,150

DATED : July 3, 1984

INVENTOR(S) : William T. Saunders, Lowell W. Austin, John R. Smith, William D. Bingle It is certified that error appears in the above-identified patent and that said Letters Patent are hereby corrected as shown below:

Column 4, line 64, after "cup" insert -- to --.

Column 6, line 43, "0.0025" should be -- 0.025 --.

Signed and Sealed this

*Sixth* Day of *November 1984*

[SEAL]

*Attest:*

GERALD J. MOSSINGHOFF

*Attesting Officer*

*Commissioner of Patents and Trademarks*